US010945465B2

(12) United States Patent
Hejazi et al.

(10) Patent No.: US 10,945,465 B2
(45) Date of Patent: Mar. 16, 2021

(54) INDUCTION HEATED SUSCEPTOR AND AEROSOL DELIVERY DEVICE

(71) Applicant: RAI Strategic Holdings, Inc., Winston-Salem, NC (US)

(72) Inventors: Vahid Hejazi, Winston-Salem, NC (US); Steven L. Alderman, Lewisville, NC (US); Eric T. Hunt, Pfafftown, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 188 days.

(21) Appl. No.: 15/921,805

(22) Filed: Mar. 15, 2018

(65) Prior Publication Data

US 2019/0281892 A1 Sep. 19, 2019

(51) Int. Cl.

| | |
|---|---|
| ***A24F 40/465*** | (2020.01) |
| ***A24F 47/00*** | (2020.01) |
| ***H05B 6/36*** | (2006.01) |
| ***H05B 6/10*** | (2006.01) |

(52) U.S. Cl.

CPC ..... *A24F 47/008* (2013.01); *A24F 40/465* (2020.01); *H05B 6/108* (2013.01); *H05B 6/365* (2013.01)

(58) Field of Classification Search

CPC ..... H05B 6/108; A24F 47/008; A24F 40/10; A24F 40/00; A24F 40/40; A24F 40/44; A24F 40/465

See application file for complete search history.

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |
| 3,200,819 | A | 8/1965 | Gilbert |
| 4,922,901 | A | 5/1990 | Brooks et al. |
| 5,060,671 | A | 10/1991 | Counts et al. |
| 5,093,894 | A | 3/1992 | Deevi et al. |
| 5,261,424 | A | 11/1993 | Sprinkel, Jr. |
| 5,388,574 | A | 2/1995 | Ingebrethsen et al. |
| 5,530,225 | A | 6/1996 | Hajaligol |
| 5,687,746 | A | 11/1997 | Rose et al. |

(Continued)

FOREIGN PATENT DOCUMENTS

| | | |
|---|---|---|
| CN | 1541577 | 11/2004 |
| CN | 2719043 | 8/2005 |

(Continued)

OTHER PUBLICATIONS

International Search Report dated May 17, 2019 in corresponding International Application No. PCT/IB2019/052013 filed Mar. 12, 2019.

*Primary Examiner* — Michael H. Wilson
*Assistant Examiner* — Yana B Krinker
(74) *Attorney, Agent, or Firm* — Womble Bond Dickinson (US) LLP

(57) ABSTRACT

An aerosol delivery device is described that includes an aerosol precursor staged within a reservoir and an atomizer configured to generate heat through induction. The atomizer has an induction transmitter and an induction receiver. The induction receiver is in operational contact with the aerosol precursor within the reservoir and is configured to wick the aerosol precursor into range of the induction transmitter to be heated and vaporized.

10 Claims, 8 Drawing Sheets

(56) References Cited

U.S. PATENT DOCUMENTS

| | | | |
|---|---|---|---|
| 5,726,421 | A | 3/1998 | Fleischhauer et al. |
| 5,865,185 | A | 2/1999 | Collins et al. |
| 5,894,841 | A | 4/1999 | Voges |
| 6,125,853 | A | 10/2000 | Susa et al. |
| 6,155,268 | A | 12/2000 | Takeuchi |
| 7,117,867 | B2 | 10/2006 | Cox et al. |
| 7,832,410 | B2 | 11/2010 | Hon |
| 8,314,591 | B2 | 11/2012 | Terry et al. |
| 8,365,742 | B2 | 2/2013 | Hon |
| 8,499,766 | B1 | 8/2013 | Newton |
| 2005/0016550 | A1 | 1/2005 | Katase |
| 2006/0196518 | A1 | 9/2006 | Hon |
| 2008/0092912 | A1 | 4/2008 | Robinson et al. |
| 2009/0095311 | A1 | 4/2009 | Hon |
| 2009/0126745 | A1 | 5/2009 | Hon |
| 2009/0188490 | A1 | 7/2009 | Hon |
| 2009/0272379 | A1 | 11/2009 | Thorens et al. |
| 2011/0094523 | A1 | 4/2011 | Thorens et al. |
| 2011/0126848 | A1 | 6/2011 | Zuber et al. |
| 2011/0155718 | A1 | 6/2011 | Greim et al. |
| 2011/0168194 | A1 | 7/2011 | Hon |
| 2011/0265806 | A1 | 11/2011 | Alarcon et al. |
| 2011/0290248 | A1 | 12/2011 | Schennum |
| 2012/0111347 | A1 | 5/2012 | Hon |
| 2012/0260927 | A1 | 10/2012 | Liu |
| 2012/0279512 | A1 | 11/2012 | Hon |
| 2013/0037041 | A1 | 2/2013 | Worm et al. |
| 2013/0056013 | A1 | 3/2013 | Terry et al. |
| 2013/0306084 | A1 | 11/2013 | Flick |
| 2014/0000638 | A1 | 1/2014 | Sebastian et al. |
| 2014/0060554 | A1 | 3/2014 | Collett et al. |
| 2014/0060555 | A1 | 3/2014 | Chang et al. |
| 2014/0096781 | A1 | 4/2014 | Sears et al. |
| 2014/0096782 | A1 | 4/2014 | Ampolini et al. |
| 2014/0209105 | A1 | 7/2014 | Sears et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0261495 | A1 | 9/2014 | Novak et al. |
| 2014/0270727 | A1 | 9/2014 | Ampolini et al. |
| 2014/0270729 | A1 | 9/2014 | DePiano et al. |
| 2014/0270730 | A1 | 9/2014 | DePiano et al. |
| 2015/0144145 | A1* | 5/2015 | Chang ..... A24F 47/008 131/328 |
| 2015/0320116 | A1 | 11/2015 | Bleloch et al. |
| 2016/0150825 | A1* | 6/2016 | Mironov ..... H05B 6/06 219/634 |
| 2017/0105452 | A1* | 4/2017 | Mironov ..... H05B 1/0244 |
| 2017/0127722 | A1* | 5/2017 | Davis ..... H05B 6/108 |
| 2017/0202266 | A1 | 7/2017 | Sur |

FOREIGN PATENT DOCUMENTS

| | | | |
|---|---|---|---|
| CN | 201379072 | 1/2010 | |
| EP | 0 295 122 | 12/1988 | |
| EP | 0 845 220 | 6/1998 | |
| EP | 1 618 803 | 1/2006 | |
| GB | 2469850 | 11/2010 | |
| TW | 201544024 | * 12/2015 | ..... A24F 47/008 |
| WO | WO 2003/034847 | 5/2003 | |
| WO | WO 2004/080216 | 9/2004 | |
| WO | WO 2005/099494 | 10/2005 | |
| WO | WO 2007/131449 | 11/2007 | |
| WO | 2017001820 A1 | 1/2017 | |
| WO | 2017029268 A1 | 2/2017 | |

* cited by examiner

INDUCTION HEATED SUSCEPTOR AND AEROSOL DELIVERY DEVICE

RELATED APPLICATIONS

The present disclosure is related to the following pending U.S. patent applications, each of which is incorporated herein in their entirety: Ser. No. 14/934,763 filed Nov. 6, 2015 to Davis et al.; Ser. No. 15/002,056 filed Jan. 20, 2016 to Sur; Ser. No. 15/352,153 filed Nov. 15, 2016 to Sur; and Ser. No. 15/799,365 filed Oct. 31, 2017 to Sebastian.

TECHNOLOGICAL FIELD

The present disclosure relates to aerosol delivery devices such as smoking articles, including electronic cigarettes, and more particularly to aerosol delivery devices that may utilize electrically generated heat for the production of aerosol. More particularly, the electrically generated heat may result from an induction-based heating system. The smoking articles may be configured to heat an aerosol precursor, which may incorporate materials that may be made or derived from, or otherwise incorporate tobacco, the precursor being capable of forming an inhalable substance for human consumption.

BACKGROUND

Many devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous alternative smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 8,881,737 to Collett et al., U.S. Pat. App. Pub. No. 2013/0255702 to Griffith Jr. et al., U.S. Pat. App. Pub. No. 2014/0000638 to Sebastian et al., U.S. Pat. App. Pub. No. 2014/0096781 to Sears et al., U.S. Pat. App. Pub. No. 2014/0096782 to Ampolini et al., U.S. Pat. App. Pub. No. 2015/0059780 to Davis et al., and U.S. patent application Ser. No. 15/222,615 to Watson et al., filed Jul. 28, 2016, all of which are incorporated herein by reference. See also, for example, the various implementations of products and heating configurations described in the background sections of U.S. Pat. No. 5,388,594 to Counts et al. and U.S. Pat. No. 8,079,371 to Robinson et al., which are incorporated by reference.

Various implementations of aerosol delivery devices employ an atomizer to produce an aerosol from an aerosol precursor composition. Such atomizers often employ direct resistive heating to produce heat. In this regard, atomizers may include a heating element comprising a coil or other member that produces heat via the electrical resistance associated with the material through which an electrical current is directly conveyed. Electrical current is typically directed through the heating element via direct electrical connections such as wires or connectors. The traditional conductive heating elements may experience significant heat loss and require a relatively high degree of power consumption due to resistive heating. Further, conductive heating elements may complicate the manufacturing process because tight tolerances are required for having a close thermal contact between heating elements and the e-liquid. Further, in some instances, conductive heating does not uniformly heat the wick of existing aerosol delivery devices, which reduces the aerosol production rate. Thus, advances with respect to aerosol delivery devices may be desirable.

BRIEF SUMMARY OF THE DISCLOSURE

The present disclosure relates to aerosol delivery devices configured to produce aerosol and which aerosol delivery devices, in some embodiments, may be referred to as electronic cigarettes or heat-not-burn cigarettes. As described hereinafter, the aerosol delivery devices may include an induction receiver and an induction transmitter, which may cooperate to form an electrical transformer. The induction transmitter may include a coil configured to create an oscillating magnetic field (e.g., a magnetic field that varies periodically with time) when alternating current is directed therethrough. The induction receiver may be positioned at least partially within or adjacent to the induction transmitter, such as in the center of an induction coil, and may include a conductive material. The induction receiver may also be configured to absorb aerosol precursor through capillary action or other means to convey aerosol precursor from a source to a heated portion of the induction receiver. Thereby, by directing alternating current through the induction transmitter, eddy currents may be generated in the induction receiver via induction. The eddy currents flowing through the resistance of the material defining the induction receiver may heat it by Joule heating. Thereby, the induction receiver, which may function as an atomizer, may be wirelessly heated to form an aerosol from an aerosol precursor composition absorbed by the induction receiver. Wireless heating, as used herein, refers to heating that occurs via an atomizer that is not physically and/or electrically connected to the electrical power source.

In one example implementation, an aerosol delivery device is provided. The aerosol delivery device comprises an aerosol precursor staged within a reservoir; and an atomizer configured to generate heat through induction. The atomizer comprises an induction transmitter and an induction receiver. The induction receiver is in operational contact with the aerosol precursor within the reservoir and is configured to wick the aerosol precursor into range of the induction transmitter to be heated and vaporized.

In some example implementations of the aerosol delivery device of any preceding or any subsequent example implementation, or any combination thereof, a control body may house a power source separably attached to a cartridge, the cartridge at least partially defining the reservoir.

In some example implementations of the aerosol delivery device of any preceding or any subsequent example implementation, or any combination thereof, the induction transmitter is at least partially housed within the cartridge to be separable from the control body.

In some example implementations of the aerosol delivery device of any preceding or any subsequent example implementation, or any combination thereof, the induction transmitter is provided with the control body to wirelessly convey energy from the control body to the cartridge.

In some example implementations of the aerosol delivery device of any preceding or any subsequent example implementation, or any combination thereof, the induction transmitter comprises a conductive coil.

In some example implementations of the aerosol delivery device of any preceding or any subsequent example implementation, or any combination thereof, the conductive coil surrounds at least a portion of the induction receiver.

In some example implementations of the aerosol delivery device of any preceding or any subsequent example implementation, or any combination thereof, the conductive coil is positioned adjacent to at least a portion of the induction receiver.

In some example implementations of the aerosol delivery device of any preceding or any subsequent example implementation, or any combination thereof, the conductive coil is wrapped around at least a portion of the induction receiver.

In some example implementations of the aerosol delivery device of any preceding or any subsequent example implementation, or any combination thereof, the induction receiver comprises an electrically conductive or semi-conductive mesh sheet material rolled into a spiral to form a cylinder.

In some example implementations of the aerosol delivery device of any preceding or any subsequent example implementation, or any combination thereof, the induction receiver comprises a porous electrically conductive or semi-conductive material, such as, for example, porous iron foam, porous graphite, or ferromagnetic ceramics. In some examples, the induction receiver comprises an annular ring, a bisecting core, and a plurality legs extending radially from the annular ring.

In some example implementations of the aerosol delivery device of any preceding or any subsequent example implementation, or any combination thereof, the induction receiver comprises a wicking core and a conductive or semi-conductive coating having a ferromagnetic material. The coating may be applied using available coating and deposition techniques, e.g., physical deposition, chemical deposition, etc. The conductive coating may be substantially permanently joined to the wicking core by sintering. The wicking core may comprise a porous ceramic.

In another example implementation, an aerosol delivery device is provided that comprises a power source, an induction transmitter, and a susceptor. The susceptor is capable of and arranged to absorb aerosol precursor. An oscillating magnetic field generated by the induction transmitter causes the susceptor to generate heat, which vaporizes at least some of the aerosol precursor absorbed by the susceptor into an aerosol.

In some example implementations of the aerosol delivery device of any preceding or any subsequent example implementation, or any combination thereof, the susceptor comprises a conductive mesh sheet material rolled into a spiral to form a cylinder.

In some example implementations of the aerosol delivery device of any preceding or any subsequent example implementation, or any combination thereof, the susceptor comprises a porous conductive material.

In some example implementations of the aerosol delivery device of any preceding or any subsequent example implementation, or any combination thereof, the susceptor comprises an annular ring, a bisecting core, and a plurality legs extending radially from the annular ring.

In some example implementations of the aerosol delivery device of any preceding or any subsequent example implementation, or any combination thereof, the susceptor comprises a wicking core and a conductive or semi-conductive coating. The coating may be substantially permanently joined to the wicking core by sintering.

BRIEF DESCRIPTION OF THE DRAWINGS

Figure 1:
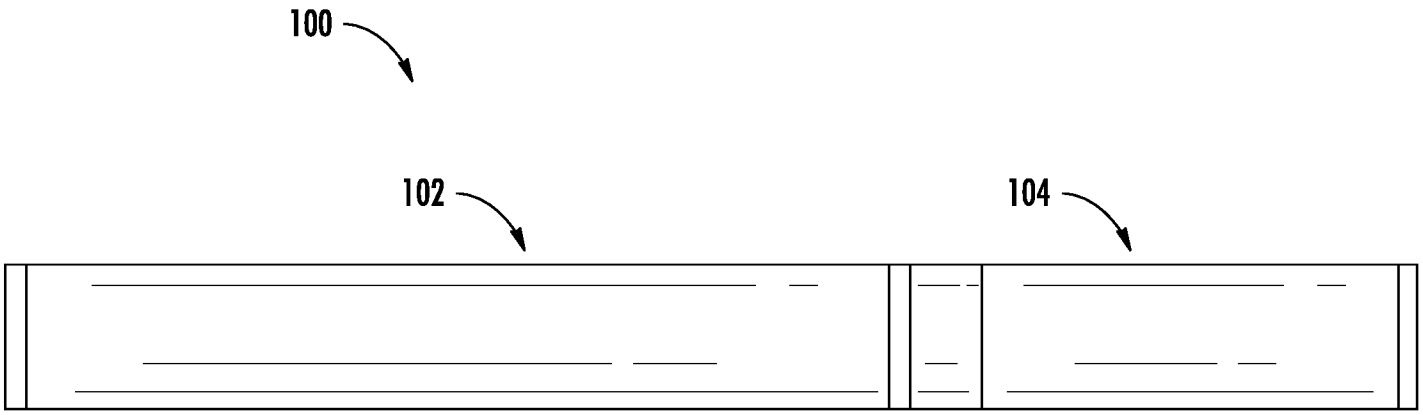
Figure 2:
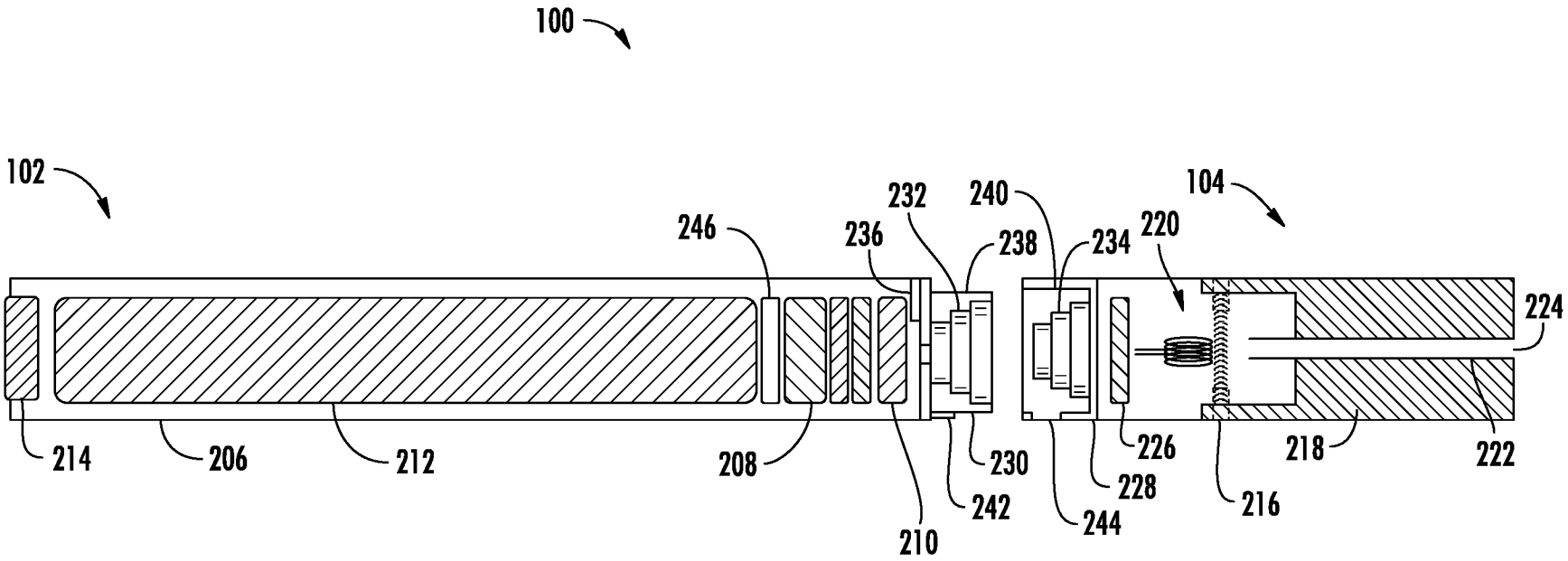
Figure 3:
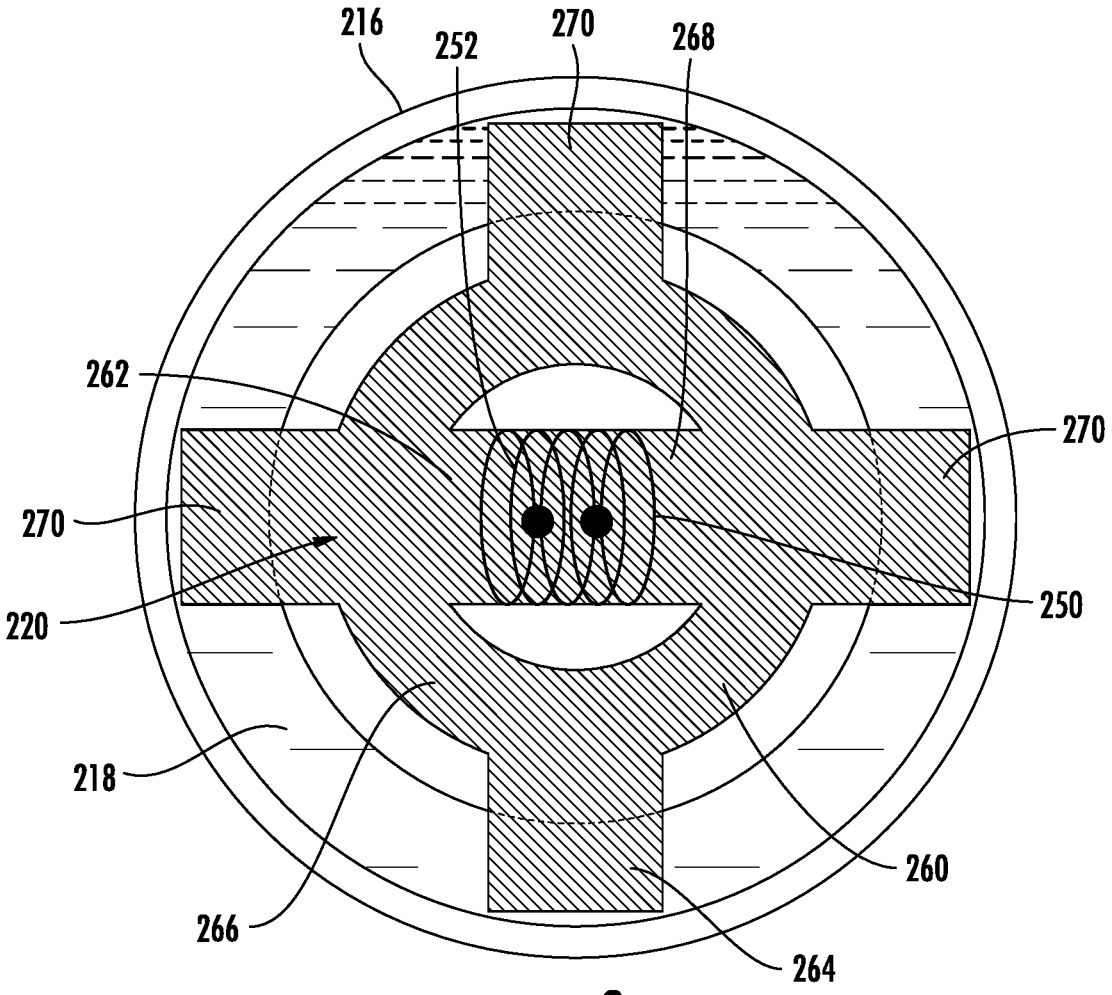

Having thus described the disclosure in the foregoing general terms, reference will now be made to the accompanying drawings, which are not necessarily drawn to scale, and wherein:

FIG. 1 illustrates a side view of an aerosol delivery device comprising a cartridge and a control body, wherein the cartridge and the control body are coupled to one another according to an example implementation of the present disclosure;

FIG. 2 illustrates a schematic cross section of an aerosol delivery device according to an example embodiment;

FIG. 3 is a detailed end view of a portion of an example atomizer according to an embodiment of the present disclosure.

Figure 4:
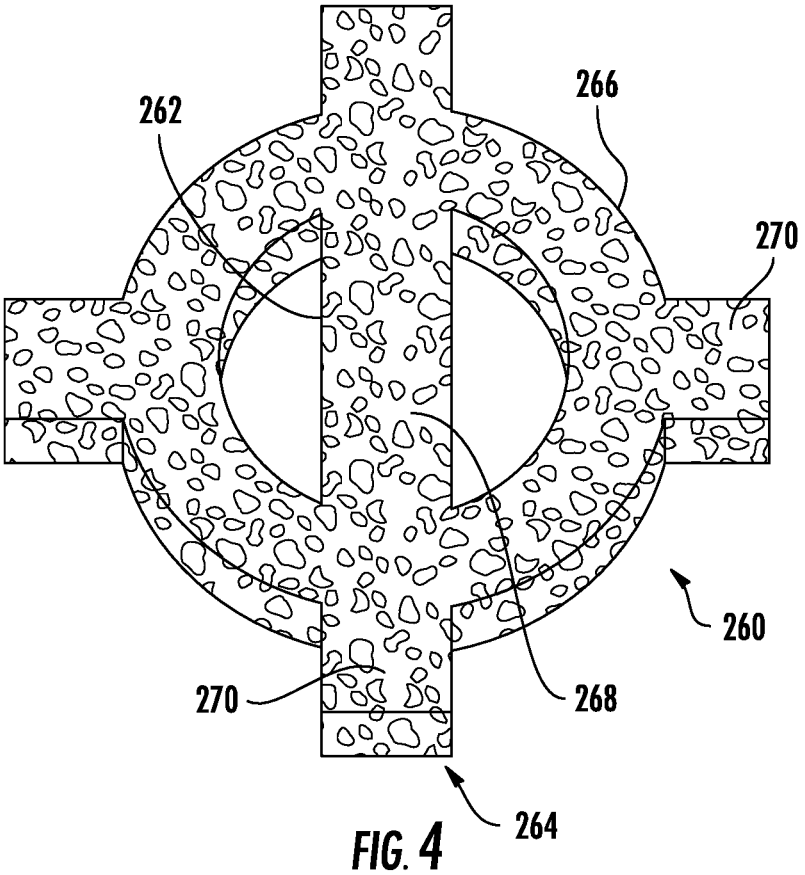
Figure 5:
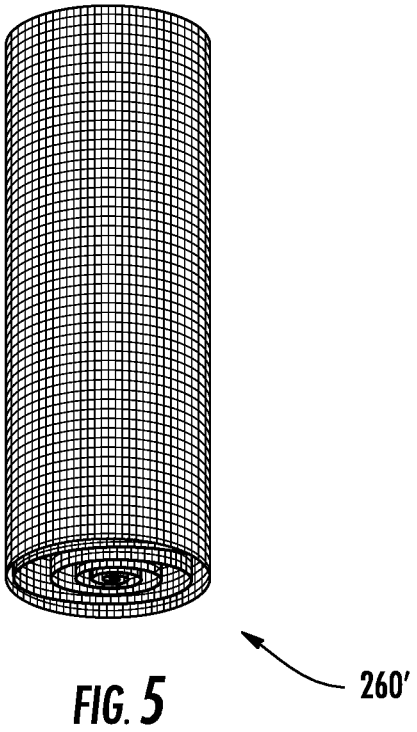
Figure 6:
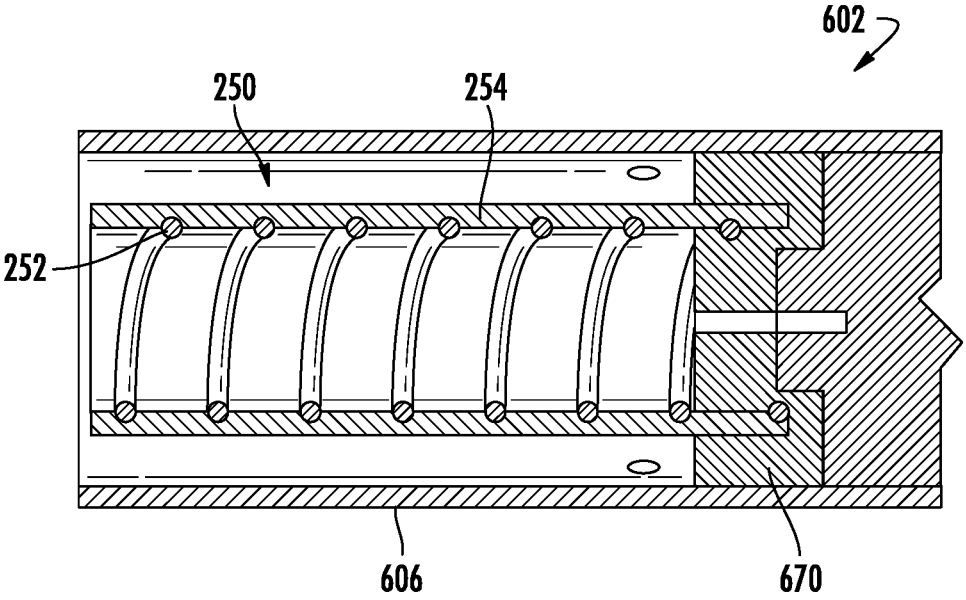
Figure 7:
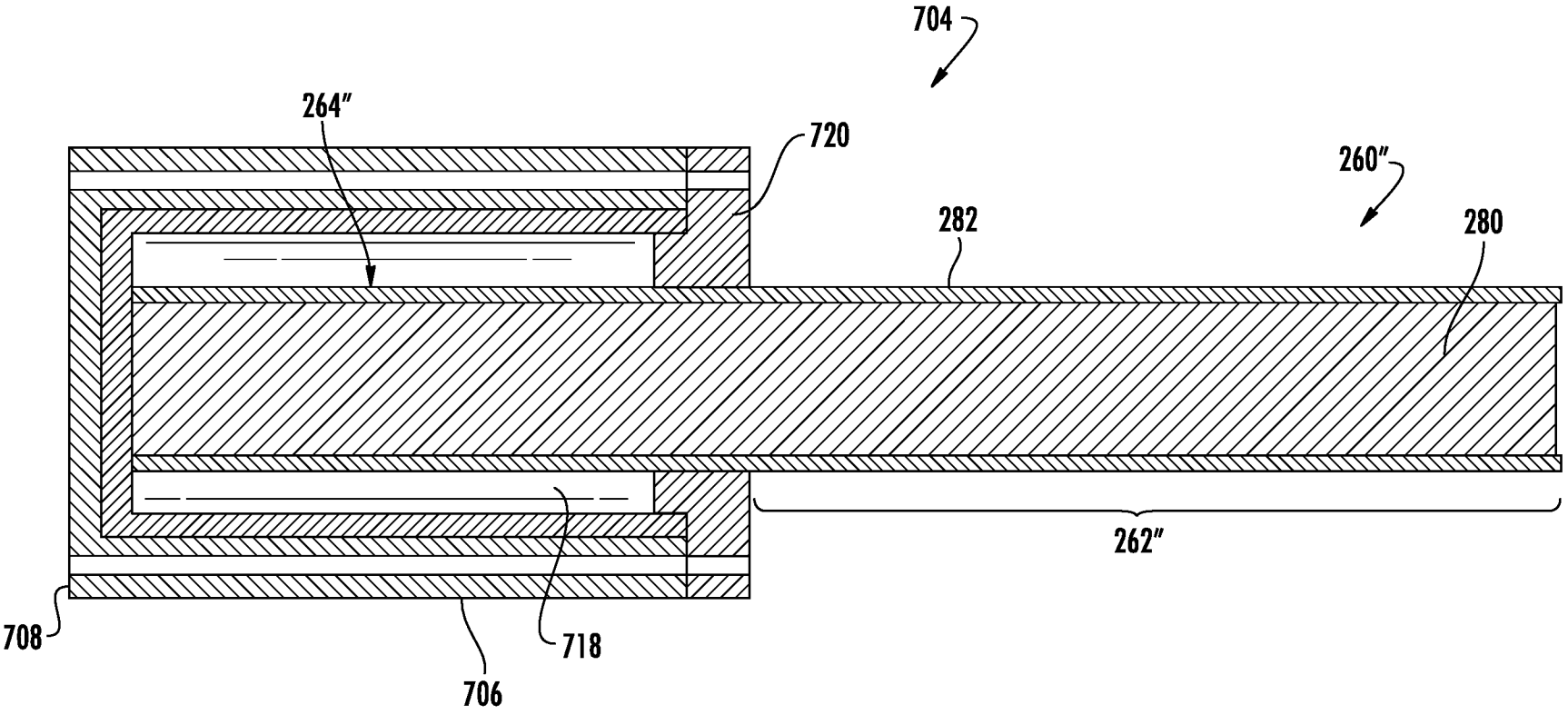
Figure 8:
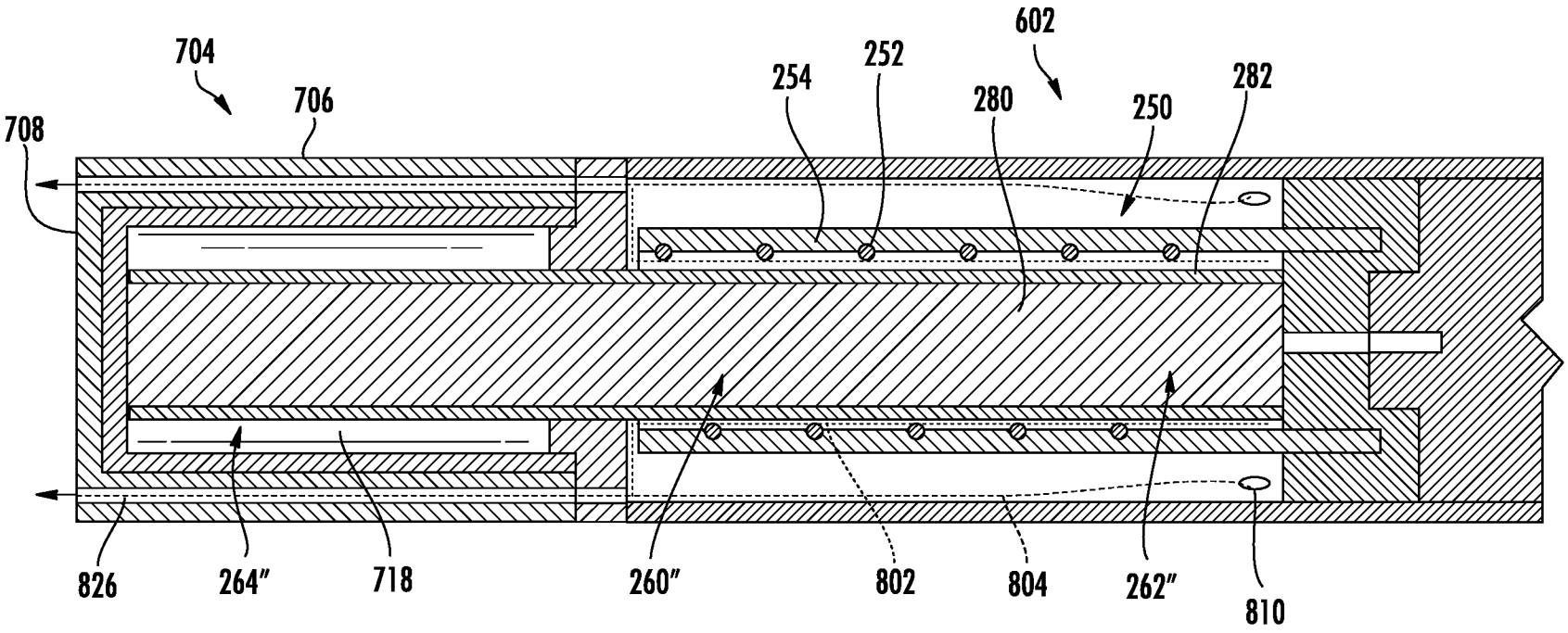

FIG. 4 shows an induction receiver according to one embodiment of the present disclosure;

FIG. 5 shows an induction receiver according to another embodiment of the present disclosure;

FIG. 6 illustrates a schematic cross section of a connection end of a control body according to another embodiment of the present disclosure;

FIG. 7 is a schematic cross section of a cartridge according to another embodiment of the present disclosure; and FIG. 8 illustrates a schematic cross section of the control body of FIG. 6 attached to the cartridge of FIG. 7.

Figure 9:
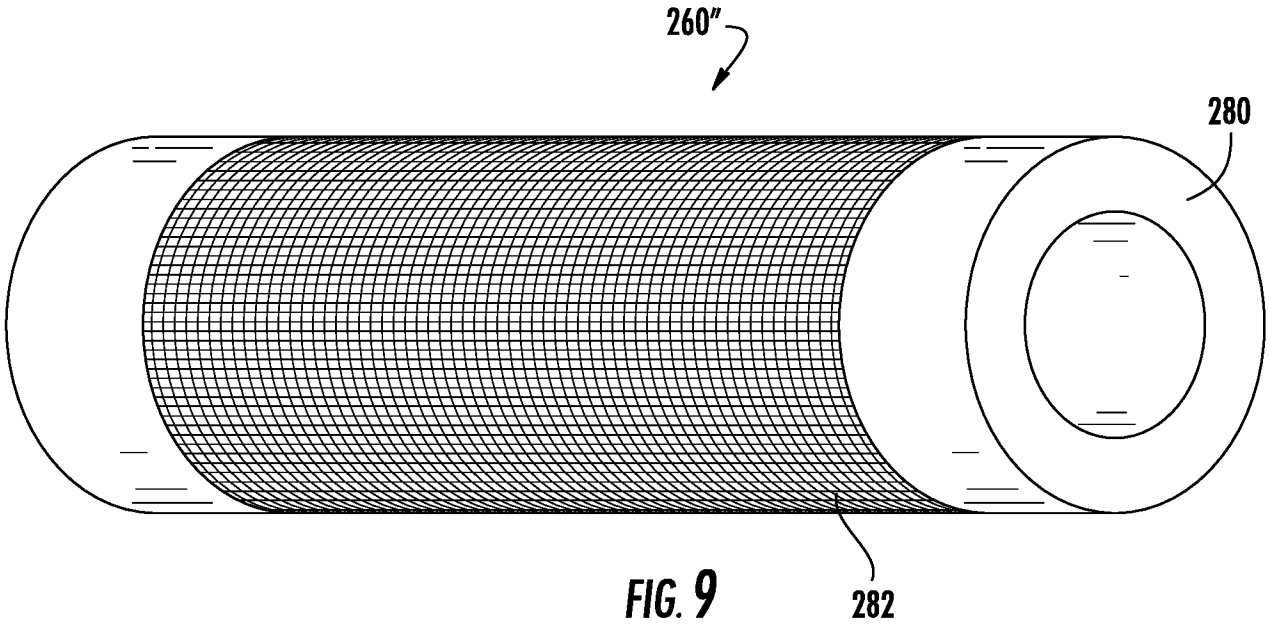

FIG. 9 illustrates an induction receiver according to an embodiment useful with the cartridge of Ha 7.

DETAILED DESCRIPTION

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As described hereinafter, example implementations of the present disclosure relate to aerosol delivery devices. Aerosol delivery devices according to the present disclosure use electrical energy to heat a material (preferably without combusting the material to any significant degree) to form an inhalable substance; and components of such systems have the form of articles most preferably are sufficiently compact to be considered hand-held devices. That is, use of components of preferred aerosol delivery devices do not result in the production of smoke in the sense that aerosol results principally from by-products of combustion or pyrolysis of tobacco, but rather, use of those preferred systems results in the production of vapors resulting from volatilization or vaporization of certain components incorporated therein. In some example implementations, components of aerosol delivery devices may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

While the systems are generally described herein in terms of implementations associated with aerosol delivery devices such as so-called "e-cigarettes," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In one example, all of the components of the aerosol delivery device are contained within one housing. Alternatively, an aerosol delivery device can comprise two or more housings that are selectively joined and are separable. For example, an aerosol delivery device can possess at one end a control body comprising a housing containing one or more reusable components (e.g., an accumulator such as a rechargeable battery and/or rechargeable supercapacitor, and various electronics for controlling the operation of that article), and at the other end and removably coupleable thereto, an outer body or shell containing a disposable portion (e.g., a disposable flavor-containing cartridge). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microprocessor, individually or as part of a microcontroller), a heater or heat generation member (which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined airflow path through the article such that aerosol generated can be withdrawn therefrom upon draw).

Alignment of the components within the aerosol delivery device of the present disclosure can vary. In specific implementations, the aerosol precursor composition can be located near an end of the aerosol delivery device which may be configured to be positioned proximal to the mouth of a user so as to maximize aerosol delivery to the user. Other configurations, however, are not excluded. Generally, a source of heat can be positioned sufficiently near the aerosol precursor composition so that the heat can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device may incorporate a battery or other electrical power source to provide current flow sufficient to provide various functionalities to the aerosol delivery device, such as powering of a heating element, powering of control systems, powering of indicators, and the like. The power source can take on various implementations. Preferably, the power source is able to deliver sufficient power to rapidly heat the heating element to provide for aerosol formation and power the aerosol delivery device through use for a desired duration of time. The power source preferably is sized to fit conveniently within the aerosol delivery device so that the aerosol delivery device can be easily handled. Additionally, a preferred power source is of a sufficiently light weight to not detract from a desirable smoking experience.

More specific formats, configurations and arrangements of components within the aerosol delivery device of the present disclosure will be evident in light of the further disclosure provided hereinafter. Additionally, the selection of various aerosol delivery device components can be appreciated upon consideration of the commercially available electronic aerosol delivery devices. Further, the arrangement of the components within the aerosol delivery device can also be appreciated upon consideration of the commercially available electronic aerosol delivery devices.

As described hereinafter, the present disclosure relates to aerosol delivery devices and components thereof. Aerosol delivery devices may be configured to heat an aerosol precursor composition to produce an aerosol. In another implementation, the aerosol delivery devices may be configured to heat and produce an aerosol from a fluid aerosol precursor composition (e.g., a liquid aerosol precursor composition). Such aerosol delivery devices may include so-called electronic cigarettes.

Regardless of the type of aerosol precursor composition heated, aerosol delivery devices may include a heating element configured to heat the aerosol precursor composition. In past implementations, the heating element may comprise a resistive heating element. Resistive heating elements may be configured to produce heat when an electrical current is directed therethrough. Such heating elements often comprise a metal material and are configured to produce heat as a result of the electrical resistance associated with passing an electrical current therethrough. Such resistive heating elements may be positioned in proximity to the aerosol precursor composition. For example, in some implementations, the resistive heating elements may comprise one or more coils of a wire wound about a liquid transport element (e.g., a wick, which may comprise a porous ceramic, carbon, cellulose acetate, polyethylene terephthalate, fiberglass, or porous sintered glass) configured to draw an aerosol precursor composition therethrough. Alternatively, the heating element may be positioned in contact with a solid or semi-solid aerosol precursor composition. Such configurations may heat the aerosol precursor composition to produce an aerosol.

Aerosol delivery devices with resistive heating elements directly in electrical connection with a power source may be employed to heat an aerosol precursor composition to produce aerosol, but such configurations may suffer from one or more disadvantages. In this regard, resistive heating elements may comprise a wire defining one or more coils adjacent to or in contact the aerosol precursor composition. For example, as noted above, the coils may wrap around a liquid transport element (e.g., a wick) to heat and aerosolize an aerosol precursor composition directed to the heating element through the liquid transport element. However, as a result of the coils defining a relatively small surface area, some of the aerosol precursor composition may be heated to an unnecessarily high extent during aerosolization, thereby wasting energy. Alternatively or additionally, some of the aerosol precursor composition that is not in contact with the coils of the heating element may be heated to an insufficient extent for aerosolization. Accordingly, insufficient aerosolization may occur, or aerosolization may occur with wasted energy. The aerosol production rate can suffer when the heating element does not uniformly heat the portion of the wick intended to release aerosols from the precursor.

Further, as noted above, resistive heating elements produce heat when electrical current is conductively directed therethrough. Accordingly, as a result of positioning the heating element in contact with the aerosol precursor composition, charring of the aerosol precursor composition may occur. Such charring may occur as a result of the heat produced by the heating element and/or as a result of electricity traveling through the aerosol precursor composition at the heating element. Charring may result in build-up of material on the heating element. Such material build-up may negatively affect the taste of the aerosol produced from the aerosol precursor composition. Induction heating structures can provide greater control over the uniform distribution of heat, and the overall temperature, to reduce the charring effects that can be caused by resistive heating elements.

In addition, aerosol delivery devices may comprise a control body including a power source and a cartridge comprising a resistive heating element and an aerosol precursor composition. In order to direct electrical current to the resistive heating element, the control body and the cartridge may include electrical connectors configured to engage one another when the cartridge is engaged with the control body. However, usage of such electrical connectors may further complicate and increase the cost of such aerosol delivery devices. Additionally, in implementations of aerosol delivery devices including a fluid aerosol precursor composition, leakage thereof may occur at the terminals or other connectors within the cartridge. Therefore some implementations of the present disclosure may eliminate the requirement of electrical contact between a portion of the control body and a portion of the cartridge.

Thus, implementations of the present disclosure are directed to aerosol delivery devices which may avoid some or all of the problems noted above.

FIG. 1 illustrates a side view of an aerosol delivery device 100 including a control body 102 and a cartridge 104, according to various example implementations of the present disclosure. In particular, FIG. 1 illustrates the control body 102 and the cartridge 104 coupled to one another. The control body 102 and the cartridge 104 may be detachably aligned in a functioning relationship. Various mechanisms may connect the cartridge to the control body to result in a threaded engagement, a press-fit engagement, an interference fit, a magnetic engagement or the like. The aerosol delivery device 100 may be substantially rod-like, substantially tubular shaped, or substantially cylindrically shaped in some example implementations when the cartridge and the control body are in an assembled configuration. The aerosol delivery device may also be substantially rectangular or rhomboidal in cross-section, which may lend itself to greater compatibility with a substantially flat or thin-film power source, such as a power source including a flat battery. The cartridge and control body may include separate, respective housings or outer bodies, which may be formed of any of a number of different materials. The housing may be formed of any suitable, structurally-sound material. In some examples, the housing may be formed of a metal or alloy, such as stainless steel, aluminum or the like. Other suitable materials include various plastics (e.g., polycarbonate), metal-plating over plastic, ceramics and the like.

In some example implementations, one or both of the control body 102 or the cartridge 104 of the aerosol delivery device 100 may be referred to as being disposable or as being reusable. For example, the control body may have a replaceable battery or a rechargeable battery and thus may be combined with any type of recharging technology, including connection to a wall charger, connection to a car charger (i.e., cigarette lighter receptacle), and connection to a computer, such as through a universal serial bus (USB) cable or connector (e.g., USB 2.0, 3.0, 3.1, USB Type-C), connection to a photovoltaic cell (sometimes referred to as a solar cell) or solar panel of solar cells, or wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. Further, in some example implementations, the cartridge may comprise a single-use cartridge, as disclosed in U.S. Pat. No. 8,910,639 to Chang et al., which is incorporated herein by reference in its entirety.

FIG. 2 more particularly illustrates the aerosol delivery device 100, in accordance with one example implementation. As seen in the cut-away view illustrated therein, again, the aerosol delivery device can comprise a control body 102 and a cartridge 104 each of which include a number of respective components. The components illustrated in FIG. 2 are representative of the components that may be present in a control body and cartridge and are not intended to limit the scope of components that are encompassed by the present disclosure. As shown, for example, the control body can be formed of a control body shell 206 that can include a control component 208 (e.g., a microprocessor, individually or as part of a microcontroller), a flow sensor 210, a power source 212 and one or more light-emitting diodes (LEDs) 214, and such components can be variably aligned. The power source may include, for example, a battery (single-use or rechargeable), solid-state battery, thin-film solid-state battery, supercapacitor or the like, or some combination thereof. Some examples of a suitable power source are provided in U.S. patent application Ser. No. 14/918,926 to Sur et al., filed Oct. 21, 2015, which is incorporated by reference. The LED may be one example of a suitable visual indicator with which the aerosol delivery device 100 may be equipped. Other indicators such as audio indicators (e.g., speakers), haptic indicators (e.g., vibration motors) or the like can be included in addition to or as an alternative to visual indicators such as the LED.

Although the control component 208 and the flow sensor 210 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some examples, the air flow sensor may comprise its own circuit board or other base element to which it can be attached. In some examples, a flexible circuit board may be utilized. A flexible circuit board may be configured into a variety of shapes, include substantially tubular shapes. In some examples, a flexible circuit board may be combined with, layered onto, or form part or all of a heater substrate as further described below.

The cartridge 104 can be formed of a cartridge shell 216 enclosing a reservoir 218 for staging aerosol precursor. An atomizer 220 is configured to use electrically generated heat to generate aerosols from the aerosol precursor. An air passage defined by a tube 222 in fluid communication with the air inlets may lead to an opening 224 present in the cartridge shell 216 (e.g., at the mouthend) to allow for egress of formed aerosol from the cartridge 104. The tube 222 may be configured to reduce or eliminate excess aerosol precursor from leaking from the opening 224.

The cartridge 104 also may include one or more electronic components 226, which may include an integrated circuit, a memory component, a sensor, or the like. The electronic components may be adapted to communicate with the control component 208 and/or with an external device by wired or wireless means. The electronic components may be positioned anywhere within the cartridge or a base 228 thereof.

The control body 102 and the cartridge 104 may include components adapted to facilitate a fluid engagement therebetween. As illustrated in FIG. 2, the control body can include a coupler 230 having a cavity 232 therein. The base 228 of the cartridge can be adapted to engage the coupler and can include a projection 234 adapted to fit within the cavity. Such engagement can facilitate a stable connection between the control body and the cartridge as well as establish an electrical connection between the power source 212 and control component 208 in the control body and the atomizer 220 in the cartridge. Further, the control body shell 206 can include an air intake 236, which may be a notch in the shell Where it connects to the coupler 230 that allows for passage of ambient air around the coupler and into the shell where it then passes through the cavity 232 of the coupler and into the cartridge through the projection 234.

A coupler and a base useful according to the present disclosure are described in U.S. Pat. App. Pub. No. 2014/0261495 to Novak et al., which is incorporated herein by reference in its entirety. For example, the coupler 230 as seen in FIG. 2 may define an outer periphery 238 configured to mate with an inner periphery 240 of the base 228. In one example the inner periphery of the base may define a radius that is substantially equal to, or slightly greater than, a radius of the outer periphery of the coupler. Further, the coupler may define one or more protrusions 242 at the outer periphery configured to engage one or more recesses 244 defined at the inner periphery of the base. However, various other examples of structures, shapes and components may be employed to couple the base to the coupler. In some examples the connection between the base of the cartridge 104 and the coupler of the control body 102 may be substantially permanent, whereas in other examples the connection therebetween may be releasable such that, for example, the control body may be reused with one or more additional cartridges that may be disposable and/or refillable.

The reservoir 218 illustrated in FIG. 2 can be a container or can be a fibrous reservoir. For example, the reservoir can comprise one or more layers of nonwoven fibers substantially formed into the shape of a tube encircling the interior of the cartridge shell 216, in this example. An aerosol precursor composition can be retained in the reservoir. Liquid components, for example, can be absorptively retained by the reservoir. The reservoir can be in fluid connection with the atomizer 220.

In use, when a user draws on the aerosol delivery device 100, airflow is detected by the flow sensor 210, and the atomizer 220 is activated to vaporize components of the aerosol precursor composition. Drawing upon the mouthend of the aerosol delivery device causes ambient air to enter the air intake 236 and pass through the cavity 232 in the coupler 230 and the central opening in the projection 234 of the base 228. In the cartridge 104 the drawn air combines with the formed vapor to form an aerosol. The aerosol is whisked, aspirated or otherwise drawn away from the atomizer 220 and out the opening 224 in the mouthend of the aerosol delivery device.

In some examples, the aerosol delivery device 100 may include a number of additional software-controlled functions. For example, the aerosol delivery device may include a power-source protection circuit configured to detect power-source input, loads on the power-source terminals, and charging input. The power-source protection circuit may include short-circuit protection, under-voltage lock out and/or over-voltage charge protection. The aerosol delivery device may also include components for ambient temperature measurement, and its control component 208 may be configured to control at least one functional element to inhibit power-source charging—particularly of any battery—if the ambient temperature is below a certain temperature (e.g., 0° C.) or above a certain temperature (e.g., 45° C.) prior to start of charging or during charging.

Power delivery from the power source 212 may vary over the course of each puff on the device 100 according to a power control mechanism. The device may include a "long puff" safety timer such that in the event that a user or component failure (e.g., flow sensor 210) causes the device to attempt to puff continuously, the control component 208 may control at least one functional element to terminate the puff automatically after some period of time (e.g., four seconds). Further, the time between puffs on the device may be restricted to less than a period of time (e.g., 100 seconds). A watchdog safety timer may automatically reset the aerosol delivery device if its control component or software running on it becomes unstable and does not service the timer within an appropriate time interval (e.g., eight seconds). Further safety protection may be provided in the event of a defective or otherwise failed flow sensor 210, such as by permanently disabling the aerosol delivery device in order to prevent inadvertent heating. A puffing limit switch may deactivate the device in the event of a pressure sensor fail causing the device to continuously activate without stopping after the four second maximum puff time.

The aerosol delivery device 100 may include a puff tracking algorithm configured for heater lockout once a defined number of puffs has been achieved for an attached cartridge (based on the number of available puffs calculated in light of the e-liquid charge in the cartridge). The aerosol delivery device may include a sleep, standby or low-power mode function whereby power delivery may be automatically cut off after a defined period of non-use. Further safety protection may be provided in that charge/discharge cycles of the power source 212 may be monitored by the control component 208 over its lifetime. After the power source has attained the equivalent of a predetermined number (e.g., 200) of full discharge and full recharge cycles, it may be declared depleted, and the control component may control at least one functional element to prevent further charging of the power source.

The various components of an aerosol delivery device according to the present disclosure can be chosen from components described in the art and commercially available. Examples of batteries that can be used according to the disclosure are described in U.S. Pat. App. Pub. No. 2010/0028766 to Peckerar et al., which is incorporated herein by reference in its entirety.

The aerosol delivery device 100 can incorporate the sensor 210 or another sensor or detector for control of supply of electric power to at least the atomizer 220 when aerosol generation is desired (e.g., upon draw during use). As such, for example, there is provided a manner or method of turning off power to the atomizer when the aerosol delivery device is not be drawn upon during use, and for turning on power to actuate or trigger the generation of heat by the atomizer during draw. Additional representative types of sensing or detection mechanisms, structure and configuration thereof, components thereof, and general methods of operation thereof, are described in U.S. Pat. No. 5,261,424 to Sprinkel, Jr., U.S. Pat. No. 5,372,148 to McCafferty et al., and PCT Pat. App. Pub. No. WO 2010/003480 to Flick all of which are incorporated herein by reference in their entireties.

The aerosol delivery device 100 most preferably incorporates the control component 208 or another control mechanism for controlling the amount of electric power to the atomizer 220 during draw. Representative types of electronic components, structure and configuration thereof, features thereof, and general methods of operation thereof, are described in U.S. Pat. No. 4,735,217 to Gerth et al., U.S. Pat. No. 4,947,874 to Brooks et al., U.S. Pat. No. 5,372,148 to McCafferty et al., U.S. Pat. No. 6,040,560 to Fleischhauer et al., U.S. Pat. No. 7,040,314 to Nguyen et al., U.S. Pat. No. 8,205,622 to Pan, U.S. Pat. App. Pub. No. 2009/0230117 to Fernando et al., Pat. App. Pub. No. 2014/0060554 to Collet et al., U.S. Pat. App. Pub. No. 2014/0270727 to Ampolini et al., and U.S. patent application Ser. No. 14/209,191 to Henry et al., filed Mar. 13, 2014, all of which are incorporated herein by reference in their entireties.

In accordance with example implementations of the present disclosure, the control component 208 may be configured to direct the current to the atomizer 220 according to a zero voltage switching (ZVS) inverter topology, which may reduce an amount of heat produced in the aerosol delivery device 100. Further implementations of the ZVS feature are described in U.S. Pat. App. Pub. No. 2017/0202266 to Sur, which is incorporated herein by reference in its entirety.

Representative types of reservoirs 218 or other components for supporting the aerosol precursor are described in U.S. Pat. No. 8,528,569 to Newton, U.S. Pat. App. Pub. No. 2014/0261487 to Chapman et al., U.S. patent application Ser. No. 14/011,992 to Davis et al., filed Aug. 28, 2013, and U.S. patent application Ser. No. 14/170,838 to Bless et al., filed Feb. 3, 2014, all of which are incorporated herein by reference in their entireties. Additionally, various wicking materials, and the configuration and operation of those wicking materials within certain types of electronic cigarettes, are set forth in U.S. Pat. App. Pub. No. 2014/0209105 to Sears et al., which is incorporated herein by reference in its entirety.

The aerosol precursor composition, also referred to as a vapor precursor composition, may comprise a variety of components including, by way of example, a polyhydric alcohol (e.g., glycerin, propylene glycol or a mixture thereof), nicotine, tobacco, tobacco extract and/or flavorants. Representative types of aerosol precursor components and formulations also are set forth and characterized in U.S. Pat. No. 7,217,320 to Robinson et al., and U.S. Pat. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU™ product by imperial Tobacco Group PLC, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

Additional representative types of components that yield visual cues or indicators 214 may be employed in the aerosol delivery device 100, such as visual indicators and related components, audio indicators, haptic indicators and the like. Examples of suitable LED components, and the configurations and uses thereof, are described in U.S. Pat. No. 5,154,192 to Sprinkel et al., U.S. Pat. No. 8,499,766 to Newton, U.S. Pat. No. 8,539,959 to Scatterday, and U.S. patent application Ser. No. 14/173,266 to Sears et al., filed Feb. 5, 2014, all of which are incorporated herein by reference in their entireties.

Yet other features, controls or components that can be incorporated into aerosol delivery devices of the present disclosure are described in U.S. Pat. No. 5,967,148 to Harris et al., U.S. Pat. No. 5,934,289 to Watkins et al, U.S. Pat. No. 5,954,979 to Counts al., U.S. Pat. No. 6,040,560 to Fleischhauer et al., U.S. Pat. No. 8,365,742 to Hon, U.S. Pat. No. 8,402,976 to Fernando et al., U.S. Pat. App. Pub. No. 2005/0016550 to Katase, U.S. Pat. App. Pub. No. 2010/0163063 to Fernando et al., U.S. Pat. App. Pub. No. 2013/0192623 to Tucker et al., U.S. Pat. App. Pub. No. 2013/0298905 to Leven et al., U.S. Pat. App. Pub. No. 2013/0180553 to Kim et al., U.S. Pat. App. Pub. No. 2014/0000638 to Sebastian et al., U.S. Pat App. Pub. No. 2014/0261495 to Novak et al., and U.S. Pat. App. Pub. No. 2014/0261408 to DePiano et al., all of which are incorporated herein by reference in their entireties.

The control component 208 includes a number of electronic components, and in some examples may be formed of a printed circuit board (PCB) that supports and electrically connects the electronic components. The electronic components may include a microprocessor or processor core, and a memory. In some examples, the control component may include a microcontroller with integrated processor core and memory, and may further include one or more integrated input/output peripherals. In some examples, the control component may be coupled to a communication interface 246 to enable wireless communication with one or more networks, computing devices or other appropriately-enabled devices. Examples of suitable communication interfaces are disclosed in U.S. patent application Ser. No. 14/638,562, filed Mar. 4, 2015, to Marion et al., the content of which is incorporated by reference in its entirety. And examples of suitable manners according to which the aerosol delivery device may be configured to wirelessly communicate are disclosed in U.S. patent application Ser. No. 14/327,776, filed Jul. 10, 2014, to Ampolini et al., and U.S. patent application Ser. No. 14/609,032, filed Jan. 29, 2015, to Henry, Jr. et al., each of which is incorporated herein by reference in its entirety.

FIG. 3 illustrates a more detailed view of the atomizer 220. In accordance with some example implementations, the atomizer 220 may include an induction transmitter 250 in conductive electrical communication with the power source 212, such as via at least the control component 208 (see e.g. FIG. 2). The induction transmitter 250 may take the form of a coil 252. Current from the power source 212 may be selectively directed to the induction transmitter 250 as controlled by the control component 208. For example, the control component 208 may direct current from the power source 212 to the induction transmitter 250 when a draw on the aerosol delivery device 100 is detected by the flow sensor 206 (FIG. 7).

The induction transmitter 250 may be configured to form a portion of an electrical transformer. In some implementations, the control component 208 may include an inverter or inverter circuit configured to transform direct current provided by the power source 212 to alternating current that is provided to the induction transmitter 250. A change in current in the induction transmitter 250, as directed thereto from the power source 212 by the control component 208, may produce an alternating (e.g. oscillating) electromagnetic field that can be used to induce eddy currents in an induction receiver 760.

The induction receiver 260, according to aspects of the present disclosure, is configured to provide the dual function of a susceptor and a wick, in some instances, the induction receiver 260 may be referred to herein as a susceptor. Therefore, according to some embodiments of the present disclosure, the induction receiver 260 comprises a material in which eddy currents may be induced, resulting in the generation of heat due to the internal resistance of the material of the induction receiver 260. Suitable materials may include metals (iron, cast iron, steel, stainless steel, aluminum, bronze), conductive carbon-based materials, ferromagnetic/piezoelectric ceramic, ceramic matrix composites (ceramic with metal/ceramic/carbon reinforcement), polymer matrix composite (polymer with metal/ceramic/carbon reinforcement), or the combination thereof.

The eddy currents attempting to flow within the material defining the induction receiver 260 may heat the induction receiver through the Joule effect, wherein the amount of heat produced is proportional to the square of the electrical current times the electrical resistance of the material of the induction receiver. In implementations of the induction receiver 260 comprising magnetic materials, heat may also be generated by magnetic hysteresis losses. Several factors contribute to the temperature rise of the induction receiver 260 including, but not limited to, proximity to the induction transmitter 250, distribution of the magnetic field, electrical resistivity of the material of the induction receiver, saturation flux density, skin effects or depth, hysteresis losses, magnetic susceptibility, magnetic permeability, and dipole moment of the material.

In this regard, both the induction receiver 260 and the induction transmitter 250 may comprise an electrically conductive material. By way of example, the induction transmitter 250 and/or the induction receiver 260 may comprise various conductive materials including metals such as cooper and aluminum, alloys of conductive materials (e.g., diamagnetic, paramagnetic, or ferromagnetic materials) or other materials such as a ceramic or glass with one or more conductive materials imbedded therein. In another implementation, the induction receiver 260 may comprise conductive particles or objects of any of various sizes and shapes received in a reservoir filled with the aerosol precursor composition. In some implementations, the induction receiver may be coated with or otherwise include a thermally conductive passivation layer (e.g., a thin layer of glass), to prevent direct contact with the aerosol precursor composition.

The induction receiver 260 may be constructed from multiple materials. For example, a susceptor region 262 of the induction receiver 260 may be configured to generate heat, and therefore may require thermally conductive materials. A wicking region 264 of the induction receiver 260 may not be required to be heated as hot. The wicking region therefore may be constructed from a low thermal conductivity material or may be coated with a material having low thermal conductivity.

By positioning the induction transmitter 250 either adjacent to or wrapped around a portion of the induction receiver 260, alternating current in the induction transmitter can be used to heat at least a portion (e.g. the susceptor region 262) of the induction receiver. The heat produced by the induction receiver 260 may heat the aerosol precursor composition, such that an aerosol or vapor is produced.

As discussed above, the induction receiver 260 may be in direct contact with the aerosol precursor staged within the reservoir 218 and act as a wick to convey aerosol precursor from the reservoir to the susceptor region 262 of the induction receiver 260. In other embodiments, the induction receiver 260 receives aerosol precursor from the reservoir 218 through an additional wicking material, thereby being in indirect contact with the aerosol precursor staged with the reservoir 218. As used herein, operational contact means capable of receiving aerosol precursor through direct or indirect contact with the aerosol precursor staged within the reservoir.

The induction receiver 260 may absorb and wick the aerosol precursor through capillary action designed into the material and structure of the induction receiver. For example, the induction receiver 260 may be a porous material, such as an open cell foam created from thermally conductive material such as an iron foam. Randomly distributed open-celled pores may absorb aerosol precursor through capillary actions. The pores may be nanopores, mesopores, micropores, macropores, or the combination thereof. The pores may be randomly-distributed or uniform-distributed pores. The porosity of the material may range between 1 and 99 percent.

In other embodiments, the induction receiver 260 may have predesigned grooves, various shape channels or crevices, holes, honeycombs, or the combination thereof, arranged in such a way that the aerosol precursor can travel from the reservoir 218 to the susceptor region 262 of the induction receiver 260, FIG. 4 is a schematic illustration of an induction receiver 260 according to a first embodiment. The induction receiver 260 is made from an iron foam having approximately 50 to 200 pores per inch, preferably about 100 pores per inch. The induction receiver 260 is configured with an annular ring 266, a bisecting core 268, and a plurality of radially extending legs 270. In the illustrated embodiment, the legs 270 may be configured to extend into contact with the aerosol precursor within the reservoir 218 (FIG. 2). The illustrated sample includes four legs 270 but the number of legs may vary, for example two, four, six, eight or even more. The number of legs 270 is also not limited to an even number. In one example, a disk shape without protruding legs 270 could be used. The legs 270 may be arranged to be equally spaced in a radial direction to provide pickup of aerosol precursor regardless of the orientation of the aerosol delivery device 100. The illustrated sample may provide advantages with respect to manufacturability and assembly. The coil 252 of the induction transmitter 250 may be positioned adjacent to the core 268 or be configured to wrap around the core.

While one example is shown in FIG. 4, the induction receiver 260 is not necessarily limited in shape, and may also include alternative shapes such as a disk, circle, tube, rectangle, spiral, rod, cube, sphere, or the combination thereof.

FIG. 5 is schematic illustration of an alternative induction receiver 260'. The induction receiver 260' is a rod shape formed by rolling a sheet of mesh material into a spirally wound column. The mesh may be constructed with a pore size ranging from about 100 to about 500 pores per inch, preferably about 220 pores per inch. The mesh may be stainless steel or other conductive materials capable of generating heat in the presence of an oscillating magnetic field. The induction receiver 260' may be arranged substantially perpendicular to the longitudinal axis of the aerosol delivery device 100 shown in FIG. 2. The induction receiver 260' may also be suitable for installation substantially parallel with a longitudinal axis of the aerosol delivery device 100 according to additional embodiments of the cartridge 104 as discussed in further detail below.

FIG. 6 schematically illustrates a partial sectional view of an engagement end of an alternative control body 602 of the aerosol delivery device 100 according to another embodiment. The illustrated embodiment may have additional advantages because the control body 602 can wirelessly transmit energy to the cartridge without a physical electrical contact through the connector 230 as used between the control body 102 and the cartridge 104 of FIG. 2. The control body 602 may have many of the same components as the control body 102 discussed above. The control body 602 may further comprise an induction transmitter 250 arranged with an outer body 606. The outer body 606 may extend from the engagement end to an outer end. The induction transmitter 250 may define a tubular configuration. As illustrated in FIG. 6, the induction transmitter 250 may include a coil 252 and a coil support 254. The coil support 254, which may define a tubular configuration, may be configured to support the coil 252 such that the coil does not move into contact with, and thereby short-circuit with, the induction receiver 260 (see, e.g. FIG. 5) or other structures. The cod support 254 may comprise a nonconductive material, which may be substantially transparent to the oscillating magnetic field produced by the coil 252. The coil support may be optional. The coil support 254 may be a thermal insulating material to limit transfer of heat to the outer body 606. The coil 252 may be imbedded in, or otherwise coupled to, the coil support 254. In the illustrated implementation, the coil 252 is engaged with an inner surface of the coil support 254 so as to reduce any losses associated with transmitting the oscillating magnetic field to the induction receiver. However, in other implementations, the coil may be positioned at an outer surface of the coil support or fully imbedded in the coil support. Further, in some implementations, the coil may comprise an electrical trace printed on or otherwise coupled to the coil support, or a wire. In either implementation, the coil may define a helical configuration.

In some implementations, the induction transmitter 250 may be coupled to a support member 670. The support member 670 may be configured to engage the induction transmitter 250 and support the induction transmitter within the outer body 606. For example, the induction transmitter 250 may be imbedded in, or otherwise coupled to the support member 670, such that the induction transmitter is fixedly positioned within the outer body 606. By way of further example, the induction transmitter 250 may be injection molded into the support member 670.

The support member 670 may engage an internal surface of the outer body 606 to provide for alignment of the support member with respect to the outer body. Thereby, as a result of the fixed coupling between the support member 670 and the induction transmitter 250, a longitudinal axis of the induction transmitter may extend substantially parallel to a longitudinal axis of the outer body 606. Thus, the induction transmitter 250 may be positioned out of contact with the outer body 606, so as to avoid transmitting current from the induction transmitter to the outer body.

The induction transmitter 250 may be configured to receive an electrical current from the power source 212 (FIG. 2) in the form of alternating current in a similar fashion as discussed above in order to produce an oscillating magnetic field.

FIG. 7 illustrates a schematic sectional view of a cartridge 704 according to an embodiment of the present disclosure that incorporates an induction receiver according to aspects of the present disclosure, for example, the induction receiver 260" illustrated and discussed in more detail below, or the induction receiver 260' shown in FIG. 5.

As illustrated, the cartridge 704 may include the induction receiver 260" extending from an outer body 706. The outer body 706 may provide a mouthpiece 708 that may be integral with the outer body. The outer body 706 may at least partially enclose a reservoir 718. A sealing member 720 may be used to substantially close the reservoir 718 while allowing aerosol precursor to pass through the sealing member via the induction receiver 260". The sealing member 720 may comprise an elastic material such as a rubber or silicone material. An adhesive may be employed to further improve the seal between the sealing member 720 and the outer body 206. In another implementation, the sealing member 720 may comprise an inelastic material such as a plastic material or a metal material. In these implementations, the sealing member 720 may be adhered or welded (e.g., via ultrasonic wielding) to the outer body 706.

The induction receiver 260" may be engaged with and extend through the sealing member 720 to locate a pickup region 264" in fluid communication with the reservoir 718 and a susceptor region 262" extending from the outer body 706, such as along the longitudinal axis of the aerosol delivery device. The induction receiver 260' formed of a rolled mesh material (FIG. 5) has a similar elongated cylindrical outer configuration to the induction receiver 260". One skilled in the art will appreciate that the induction receiver 260' may form a part of the cartridge 704 in much the same configuration as shown in FIG. 7.

In one implementation, the induction receiver 260" may be partially imbedded in the sealing member 720. For example, the induction receiver 260" may be injection molded into the sealing member 720 such that a tight seal and connection is formed therebetween. Accordingly, the sealing member 720 nay retain the induction receiver at a desired position. For example, the induction receiver 260" may be positioned such that a longitudinal axis of the induction receiver extends substantially coaxially with a longitudinal axis of the outer body 706.

In other embodiments, not shown, the induction receiver 260" may extend into fluid contact with the reservoir 718 through the outer body 706 and the sealing member 720 may be located on an opposite end of the cartridge 704. The sealing member 720 may be removable to allow the reservoir 720 to be re-filled with aerosol precursor.

As noted above, each of the cartridges 104, 704 of the present disclosure is configured to operate in conjunction with the control body 102, 602 to produce an aerosol. By way of example, FIG. 8 illustrates the cartridge 704 engaged with the control body 602. As illustrated, when the control body 602 is engaged with the cartridge 704, the induction transmitter 250 may at least partially surround, and in some such implementations may substantially surround or fully surround, at least the susceptor region 262" of the induction receiver 260" by extending around the circumference thereof). Further, the induction transmitter 250 may extend along at least a portion of the longitudinal length of the induction receiver 262". In some embodiments the induction transmitter 250 may extend along a majority of the longitudinal length of the induction receiver 262". In other implementations, the induction transmitter 250 may extend along substantially all of the longitudinal length of the induction receiver 262" that is external of the reservoir 718.

Accordingly, when a user draws on the mouthpiece 708 of the cartridge 704, the control component 208 (FIG. 2) may direct current from the power source 212 to the induction transmitter 250. The induction transmitter 250 may thereby produce an oscillating magnetic field. As a result of the induction receiver 260" being adjacent to the induction transmitter 250, such as in implementations in which the induction receiver 260" is at least partially surrounded by the induction transmitter 250, the induction receiver may be exposed to the oscillating magnetic field produced by the induction transmitter. As a result, the eddy currents flowing in the material defining the induction receiver 260" may heat the induction receiver through the Joule effect. Accordingly, the heat produced by the induction receiver 260" may heat the aerosol precursor that has been wicked from the reservoir 718 by the wicking region 264" to the susceptor region 262" outside of the outer body 706.

The aerosol 802 may mix with air 804 entering through inlets 810, which may be defined in the control body 602. Accordingly, an intermixed air and aerosol may be directed to the user. For example, the intermixed air and aerosol may be directed to the user through one or more through holes 826 defined in the outer body 706 of the cartridge 704. However, as may be understood, the flow pattern through the aerosol delivery device 100 may vary from the particular configuration described above in any of various manners without departing from the scope of the present disclosure.

FIG. 9 schematically illustrates the induction receiver 260" according to the embodiment in FIG. 8. The induction receiver 260" may also be suitable for use in the cartridge 104 as shown and described with respect to FIGS. 2 and 3. Similar to the induction receivers 260 and 260' described above, the illustrated embodiment of FIG. 9 provides both the heating properties of a susceptor and the fluid transport properties of a wick in a single structure. Unlike some embodiments of the induction receivers discussed above, the present embodiment uses a single structure formed from more than one material. The induction receiver 260" includes a wicking core 280 formed from a suitable material such as a porous ceramic cylinder. The susceptor characteristics of the induction receiver 260" are added to the wicking core 280 by applying a conductive or semi-conductive coating 282, such as an exterior coating, comprising suitable ferromagnetic materials such as aluminum oxide, iron oxide or combinations thereof. The coating 282 may be permanently joined with the wicking core 280 through an appropriate process such as sintering. The coating 282 and wicking core 280 may then be used in place of either the induction receiver 260 or the induction receiver 260'.

In one example, a layer by layer coating method was used to coat a ceramic surface with micro to nanosize iron oxide particles. The coating procedure included the following steps: 1) the wicking core was heated at 400-500° C. for 30 min, 2) the wicking core was immersed in 1.5-2% (w/w)

polydially dimethyl-ammonium chloride (PDDA) solution for 2 minutes and dried at 70° C. for 1 hour using the oven, 3) the wicking core was immersed in 1.5-2% (w/w) carboxymethyl cellulose solution for 2 minutes and dried at 70° C. for 1 hour, 4) the induction receiver was then immersed in a colloidal iron oxide solution for 5 minutes which contained 5-10 mM sodium perchlorate as a destabilizer and dried at 70° C. Finally, the coated wick was sintered at 400-500° C. for 30 minutes in the oven to stabilize the iron oxide particles coating on the ceramic wick surface.

In the example process above, other inorganic compounds may be used in place of the PDDA to activate the surface of the wicking core for creating a stronger bond. In the example process above, the concentration of the materials, the temperatures, and the duration for each step can be varied. In other embodiments, other iron oxide precursors such as $FeCl_3$ or $Fe(NO_3)_3$ instead of using iron oxide particles and sodium perchlorate electrolyte. The steps 3 and 4 can be repeated, for example repeated between about two and about 100 times, depending on the thickness of the iron oxide film required to absorb electromagnetic waves and circulate maximum eddy current. Other common coating and deposition techniques may be used as well.

Having described suitable induction receivers 260, 260' and 260" according to aspects of the present disclosure that are configured as susceptors that are capable of wicking aerosol precursor, a method of forming an aerosol will be apparent to one of ordinary skill in the art. For example, the induction receivers of the present disclosure can facilitate a method of forming aerosols that includes a step of absorbing aerosol precursor into a susceptor, such as the induction receivers discussed herein. The method can also include the step of inducing the susceptor to generate sufficient heat to vaporize at least a portion of the aerosol precursor absorbed within the susceptor as the result of generating an oscillating magnetic field in the vicinity of the susceptor.

Many modifications and other implementations of the disclosure will come to mind to one skilled in the art to which this disclosure pertains having the benefit of the teachings presented in the foregoing descriptions and the associated drawings. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

The invention claimed is:

1. An aerosol delivery device comprising:

an aerosol precursor staged within a reservoir; and an atomizer configured to generate heat through induction, wherein the atomizer comprises an induction transmitter and an induction receiver, wherein the induction receiver is in operational contact with the aerosol precursor within the reservoir and is configured to wick the aerosol precursor into range of the induction transmitter to be heated and vaporized, wherein the induction receiver comprises a porous conductive material, and wherein the induction receiver comprises an annular ring, a bisecting core, and a plurality legs extending radially from the annular ring.

2. The aerosol delivery device of claim 1, further comprising a control body housing a power source separably attached to a cartridge, the cartridge at least partially defining the reservoir.

3. The aerosol delivery device of claim 2, wherein the induction transmitter is provided with the control body to wirelessly convey energy from the control body to the cartridge.

4. The aerosol delivery device of claim 1, wherein the induction transmitter comprises a conductive coil.

5. The aerosol delivery device of claim 4, wherein the conductive coil surrounds at least a portion of the induction receiver.

6. The aerosol delivery device of claim 4, wherein the conductive coil is positioned adjacent to at least a portion of the induction receiver.

7. The aerosol delivery device of claim 1, wherein the induction receiver comprises a porous electrically conductive or semi-conductive material selected from metals, ferromagnetic ceramics, or graphite.

8. The aerosol delivery device of claim 7, wherein the induction receiver comprises porous iron foam.

9. An aerosol delivery device, comprising:

a power source;

an induction transmitter; and a susceptor, wherein the susceptor is capable of and arranged to absorb aerosol precursor, wherein the induction transmitter is configured to generate an oscillating magnetic field, and wherein the susceptor is configured to generate heat in response to the oscillating magnetic field to vaporize at least some of the aerosol precursor absorbed by the susceptor into an aerosol, wherein the susceptor comprises a porous conductive material, and wherein the susceptor comprises an annular ring, a bisecting core, and a plurality legs extending radially from the annular ring.

10. The aerosol delivery device of claim 9, wherein the susceptor comprises a porous conductive material.

* * * * *